US006877559B2

(12) United States Patent
Hashem

(10) Patent No.: US 6,877,559 B2
(45) Date of Patent: Apr. 12, 2005

(54) RETRIEVING A SAMPLE OF FORMATION FLUID IN AS CASED HOLE

(75) Inventor: Mohamed Naguib Hashem, New Orleans, LA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/362,033

(22) PCT Filed: Jan. 15, 2002

(86) PCT No.: PCT/EP02/00521

§ 371 (c)(1),
(2), (4) Date: Feb. 18, 2003

(87) PCT Pub. No.: WO02/057598

PCT Pub. Date: Jul. 25, 2002

(65) Prior Publication Data

US 2003/0183422 A1 Oct. 2, 2003

(30) Foreign Application Priority Data

Jan. 18, 2001 (EP) ..... 01200178

(51) Int. Cl.[7] ..... E21B 29/00; E21B 49/08; E21B 49/10

(52) U.S. Cl. ..... 166/264; 166/254.2; 166/250.12; 166/298; 166/55.1; 175/41; 175/59; 73/152.17; 73/152.26

(58) Field of Search ..... 166/250.01, 254.1, 166/254.2, 250.12, 250.17, 264, 297, 298, 55, 55.1; 175/41, 58, 59; 73/152.01, 152.02, 152.17, 152.18, 152.23, 152.24, 152.26

(56) References Cited

U.S. PATENT DOCUMENTS 2,451,520 A * 10/1948 Teplitz ..... 166/253.1
4,222,438 A * 9/1980 Hollingsworth et al. .... 166/264
4,254,832 A * 3/1981 Patton et al. ..... 166/332.4
4,552,234 A * 11/1985 Revett ..... 175/4.6
4,597,439 A * 7/1986 Meek ..... 166/163
4,635,717 A * 1/1987 Jageler ..... 166/250.01
4,690,216 A * 9/1987 Pritchard, Jr. ..... 166/264
4,780,266 A * 10/1988 Jordan et al. ..... 376/162
4,856,585 A * 8/1989 White et al. ..... 166/323
4,879,900 A * 11/1989 Gilbert ..... 73/152.26
4,915,171 A * 4/1990 McMahan ..... 166/264
4,960,171 A * 10/1990 Parrott et al. ..... 166/55
5,293,931 A * 3/1994 Nichols et al. ..... 166/54.1
5,337,821 A * 8/1994 Peterson ..... 166/250.07
5,353,637 A * 10/1994 Plumb et al. ..... 73/152.17
5,353,875 A * 10/1994 Schultz et al. ..... 166/297
5,392,857 A * 2/1995 Behrmann ..... 166/297
5,441,110 A * 8/1995 Scott, III ..... 166/308.1
5,799,733 A * 9/1998 Ringgenberg et al. ..... 166/264
6,006,834 A * 12/1999 Skinner ..... 166/250.17
6,014,933 A * 1/2000 Umphries et al. ..... 102/312
6,431,278 B1 * 8/2002 Guinot et al. ..... 166/252.5
6,640,908 B1 * 11/2003 Jones et al. ..... 175/50
2002/0100585 A1 * 8/2002 Spiers et al. ..... 166/264

FOREIGN PATENT DOCUMENTS

EP 0 697 502 2/1996 ..... E21B/49/10
FR 2 742 795 6/1997 ..... E21B/49/10

* cited by examiner

*Primary Examiner*—David Bagnell
*Assistant Examiner*—Jennifer Gay

(57) ABSTRACT

A method for retrieving a formation fluid sample through a cased borehole utilizing a sampling tool. Sampling tool straddle packers are set about a first set of perforations and annular fluid is drained from the isolated zone, through a central conduit in the tool and discharged above or below the packers. Formation fluid is induced to flow into the central conduit and into sample chambers. The packers are unset, the tool moved to the next set of perforations that are azimuthally offset from the first set of perforations and the sampling process repeated, with subsequent samples being placed in separate sample chambers.

5 Claims, 2 Drawing Sheets

RETRIEVING A SAMPLE OF FORMATION FLUID IN AS CASED HOLE

The present application claims priority on European Patent Application 01200178.0, filed on 18 Jan. 2001.

FIELD OF THE INVENTION

The present invention relates to retrieving a sample of formation fluid from a formation layer traversed by a cased borehole. The formation layer is a hydrocarbon-bearing formation layer or a formation layer that is expected to contain hydrocarbons.

BACKGROUND OF THE INVENTION

A cased borehole is a borehole lined with a casing that has been cemented in the borehole so that the annulus between the outer surface of the casing and the inner surface of the borehole is filled with set cement. The casing is filled with liquid used to displace the cement out of the casing and into the annulus, before the cement sets. The liquid in the casing is so dense that fluids are prevented from entering into the casing.

In order to obtain a sample of the formation fluid from the formation layer, the casing wall is perforated in a predetermined interval within that formation layer. The tool used to create the perforations, is a perforating gun. This is an elongated body provided with a plurality of outwardly directed charges. The charges are arranged at different locations along the body oriented in different directions, and they can be activated electrically or mechanically. The charges are so designed that each charge on activation produces a perforation including a perforation tunnel that extends through the wall of the casing into the formation surrounding the borehole. The perforating gun can be lowered into the cased borehole by means of for example a wireline.

In order to obtain a fluid sample, the perforating gun is lowered to the predetermined depth and the charges are activated to create a plurality of perforations. The liquid present in the casing prevents formation fluid from entering into the casing.

Then a sampling tool is lowered into the cased borehole by means of for example a wireline. The sampling tool comprises a central conduit having an inlet and a discharge, a fluid sample container opening into the central conduit, and a system for discharging fluids from the central conduit and for moving fluids into the fluid sample container. The sampling tool is further provided with an upper and a lower packer arranged at either side of the inlet of the central conduit, wherein the discharge opens below the lower packer. The distance between the upper and the lower packer is greater than the height of the perforations.

The sampling tool is so positioned that the upper packer is located above the perforations and the lower packer below the perforations. Then the packers are set to seal off a sampling space between the packers into which all the perforations open.

The system for discharging fluids from the central conduit and for moving fluids into the fluid sample container includes a pump 58 (FIG. 1). The pump 58 is activated to remove the liquid from the sampling space. The time required to remove the liquid from the sampling space is substantially equal to the volume of the sampling space divided by the pump rate.

The pump is further activated and the fluid that enters into the central conduit is now moved into the sample container.

Once the sample container is filled, it is sealed off and the sampling tool is retrieved from the borehole.

At surface the sample container is brought to a laboratory for further analysis. This analysis is important because it can give an answer to the question whether or not the formation fluid is a valuable hydrocarbon.

Unfortunately, the sampled fluid need not always represent the formation fluid. For example when the cement in the annulus does not completely fill the annulus, there is a channel with a low resistance to fluid flow. Thus fluids from the channel will preferentially be drawn into the sampling space.

SUMMARY OF THE INVENTION

It is an object of the present invention to overcome this drawback and to provide a method to obtain a fluid sample correctly representing the formation fluid.

To this end the method of retrieving a sample of formation fluid from a formation layer traversed by a cased borehole according to the present invention comprises the steps of:

a) making a plurality of perforation sets through the casing wall into the formation layer, wherein the orientation of the perforation sets is so selected that the angle between adjacent perforation sets equals 360° divided by the number of perforation sets;

b) lowering a sampling tool into the borehole to the first perforation set, which sampling tool comprises a central conduit having an inlet and a discharge, several fluid sample containers opening into the central conduit, and a system for discharging fluids from the central conduit and for moving fluids into the fluid sample containers, which sampling tool is provided with an upper and a lower packer arranged at either side of the inlet of the central conduit, wherein the discharge opens above the upper packer or below the lower packer, wherein the distance between the upper and the lower packer is larger than the height of a perforation set, wherein the length of the longest packer is smaller than the spacing between adjacent perforation sets;

c) setting the packers so that the perforation set is straddled between the packers, taking a sample from the formation, storing the sample in the first fluid sample container and shutting off the first fluid sample container;

d) positioning the sampling tool near the next perforation set, setting the packers so that the perforation set is straddled between the packers, taking a sample from the formation, storing the sample in the next fluid sample container and shutting off the next fluid sample container; and e) repeating step d) until samples from at most all perforation sets have been taken, and retrieving the sampling tool.

DETAILED DESCRIPTION OF THE PREFERRED EMBODIMENTS

In the specification and the claims the expression a perforation set refers to at least one perforation, wherein, when the set contains two or more perforations, these perforations have the same orientation.

The method of retrieving a sample of formation fluid from a formation layer 20 traversed by a cased borehole according to the invention will now be described in more detail.

Figure 1:
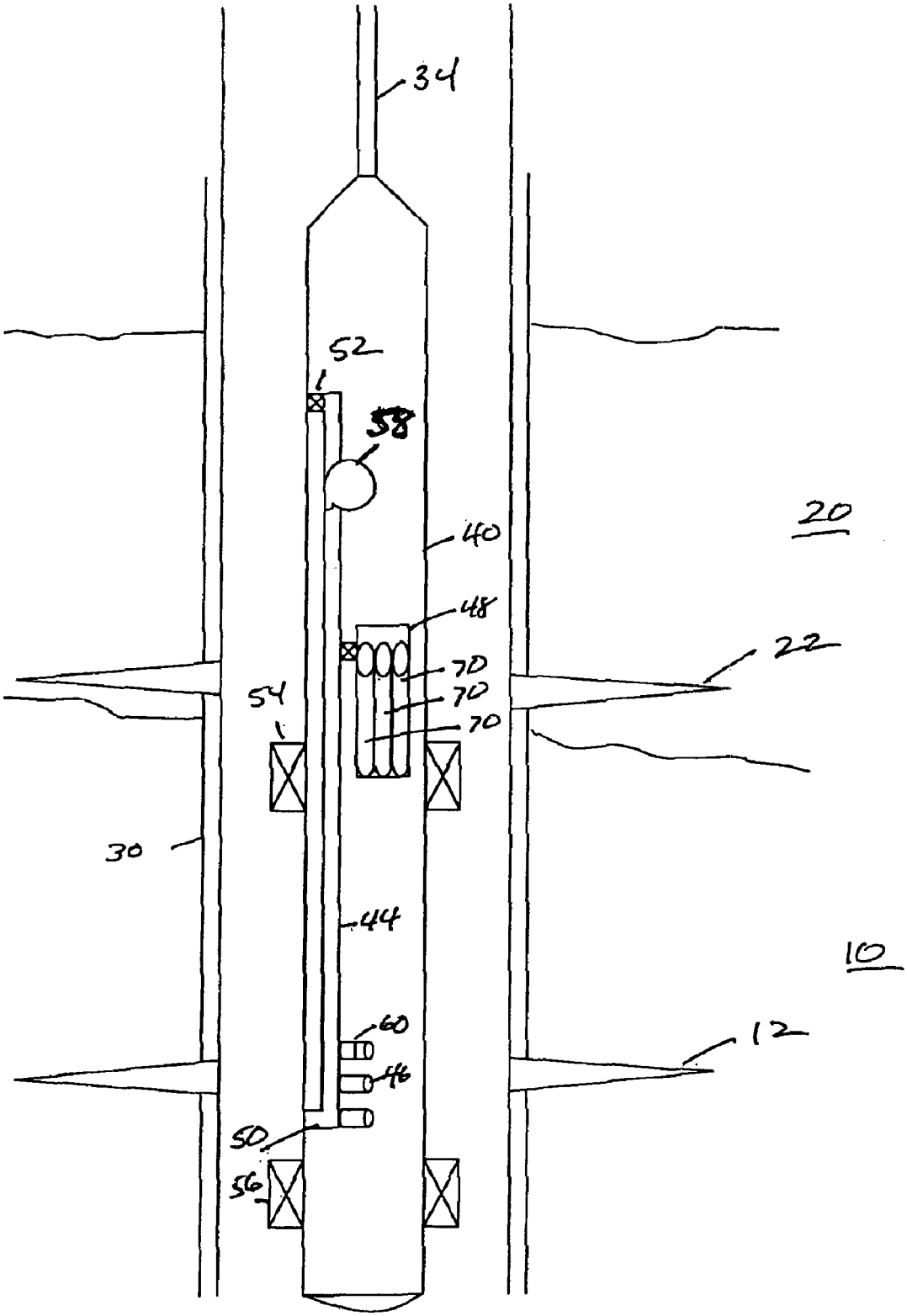
FIG. 1 is a depiction of a tool used to practice the method of the present invention.

With reference to FIG. 1, in order to obtain samples from the formation fluid, first the casing 30 is perforated. The perforations are depicted as 12 and 22 in formation layers 10 and 20 respectively. According to the present invention, perforating the casing 30 involves making a plurality of perforation sets through the casing wall into the formation layer 20. The height of each perforation set 22 is less than the distance between the upper 54 and the lower packer 56 of the sampling tool 40 and the spacing between adjacent perforation sets 12 is at least equal to the length of the longest packer of the sampling tool 40. This ensures that, with the sampling tool 40 in place a sampling volume between the packers 54, 56 can cover one and only one perforation set 22. Moreover, the orientation of the perforation sets 22 is so selected that the angle between adjacent perforation sets equals 360° divided by the number of perforation sets. In this way it is obtained that samples are along the circumference of the casing 30, but a single sample can be taken from a particular direction and at a different level. Thus the likelihood that all sampled are contaminated is negligible. This would for example occur if there is no cement behind the casing.

Then a sampling tool 40 is lowered into the cased borehole 32 to the first, lowermost, perforation set. The sampling tool 40 comprises a central conduit 44 having an inlet 50 and a discharge 52, a fluid sampling area 48, containing several fluid sample containers 70 opening into in fluid communications the central conduit, and a system, in this instance, a pump, 58 for discharging fluids from the central conduit and for moving fluids into the fluid sample containers. Furthermore the sampling tool 40 is provided with an upper 54 and a lower packer 56 arranged at either side of the inlet 50 of the central conduit 44. The discharge 52 of the central conduit 44 opens above the upper packer 54 or below the lower packer 56. The location of the discharge 52 depends on the design of the tool 40, but it should be located outside the sampling space between the packers.

The sampling tool 40 can be for example by lowered by means of for example a wireline 34.

Figure 2:
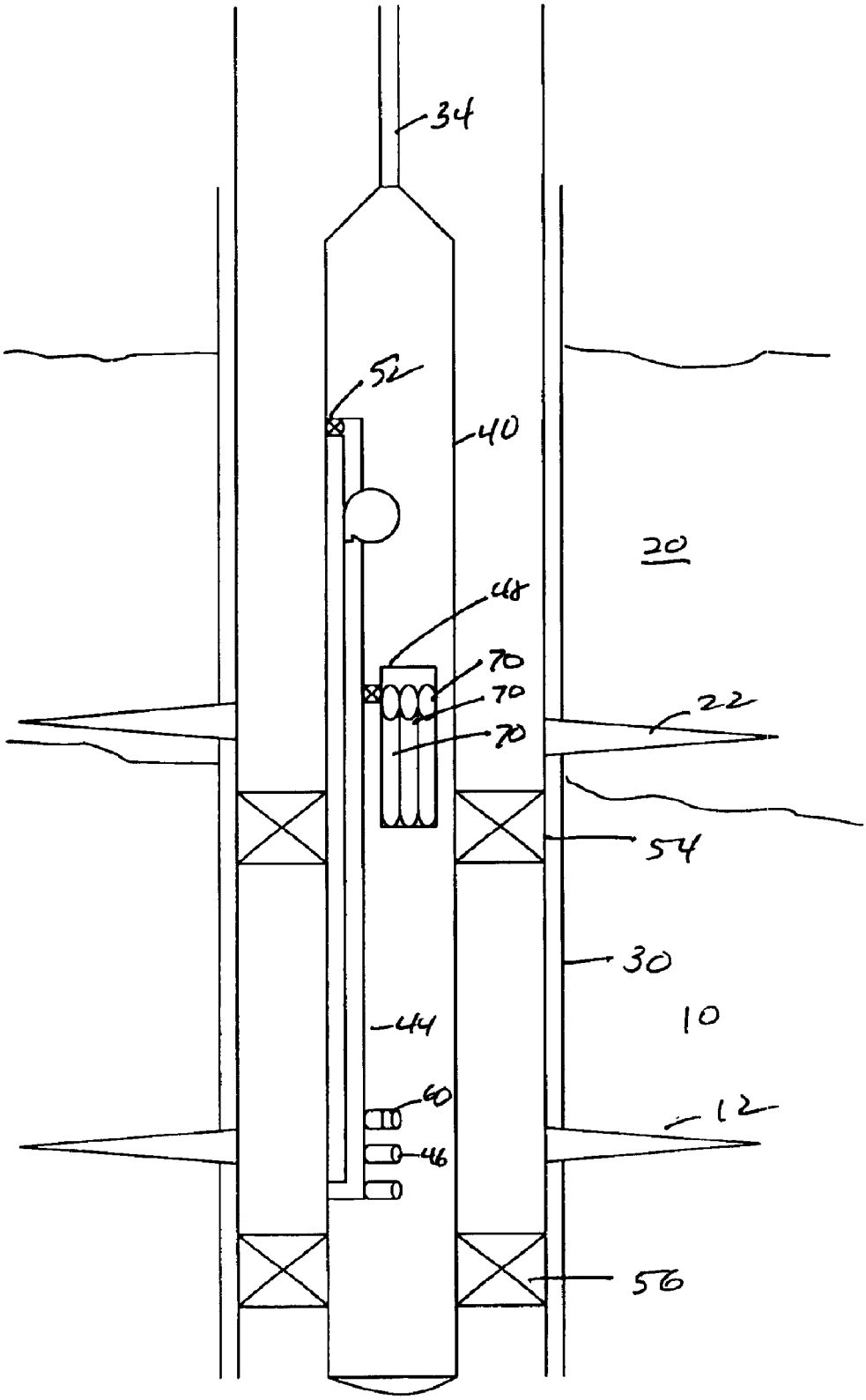
FIG. 2 is a depiction of a tool used to practice the method of the present invention with the packers sealing off an isolation zone.

In FIG. 2, the packers 54, 56 are set so that the perforation set 22 is straddled between the upper and lower packer. In this way the sampling space between the packers 54, 56 is isolated from the remainder of the casing. Fluids are sucked into the central conduit 44 and discharged until the volume of the sampling space had been displaced. Then a sample is taken from the formation and it is stored in the first fluid sample container 70. When the sample is stored, the first fluid sample container 70 is shut off. Taking a sample can be preceded by discharging the contents of the sampling space to the space below the lower packer 56, or above the upper packer 54.

When the first sample is taken, the sampling tool 40 is positioned near the next higher perforation set 12. The packers 54, 56 are set so that the perforation set 22 is straddled between the packers 54,56. A sample is taken from the formation and it is stored in the next fluid sample container 70 which next fluid sample container 70 is thereafter shut-off.

The latter step is repeated until samples have been taken from at most all perforation sets. The sampling tool is retrieved from the cased borehole.

At surface the fluid sample containers are removed from the sampling tool and their contents are analysed in a laboratory to obtain the relevant information.

Suitably, the step of taking a sample from a next perforation set is repeated until samples from all perforation sets have been taken.

In an alternative embodiment of the invention, the sampling tool 40 further comprises a fluid analyzer 46 (See FIG. 1) in fluid communication with the central conduit 44. The fluid analyzer 46 may from optical, magnetic resonance imaging or other analyzer types known in the art. Then the step of taking a sample from a next perforation set 12 is repeated until formation fluid is detected.

For example, samples are to be taken from a sand layer having a thickness of 40 m through a cased borehole traversing the sand layer. The height of the perforation set is 0.5 m and the spacing between adjacent perforation sets is 1.5 m. Therefore the number of perforation sets is 20 (=40/(0.5+1.5)) and the angle between two adjacent perforation sets is 18° (=360°/20). The length of the packer on the sampling tool is about 0.5 m, which is smaller than the spacing of 1.5 m, and the distance between the nearest ends of the packers is 1.5 m. The sampling tool in this case must have at most 20 fluid sample containers.

Suitably, the lowermost perforation 22 is marked, and the sampling tool 40 further comprises a device 60 for detecting the marker. The marker is suitably a radioactive tracer that may be introduced into the formation be placing a chemical isotope or other low level source in a shaped charge that is sent into the formation upon perforation, and the sampling tool detector 60 is suitably a nuclear detector for detecting the radioactive tracer. Alternatively, a separate tool, such as a gamma ray detector (not shown) may be used in conjunction with the sampling tool 40.

The invention provides a simple way to ensure that at least one of the samples taken correctly represents the formation fluid.

What is claimed is:

1. A method of retrieving a sample of formation fluid from a formation layer traversed by a cased borehole comprising the steps of:

a) making a plurality of perforation sets through the casing wall into the formation layer, wherein the orientation of the perforation sets is selected so that the angle between adjacent perforation sets equals 360° divided by the number of perforation sets, the perforation sets being further vertically distinct one from the other;

b) lowering a sampling tool into the borehole to the first perforation set, an annulus being formed between said sampling tool and said casing wall, said sampling tool comprised of a tool body, a central conduit in the tool body, having an inlet and a discharge in fluid communication with said annulus, multiple fluid sample container in fluid communication with the central conduit, a system for drawing fluids into and discharging fluids from the central conduit, a system for selectively opening and closing the fluid sample containers, the sampling tool having selectively expandable upper and a lower packers arranged at either side of the inlet of the central conduit, wherein the discharge opens above the upper packer or below the lower packer, wherein the distance between the upper and the lower packer is larger than the height of a perforation set, wherein the length of the longest packer is smaller than the spacing between adjacent perforation sets;

c) setting the packers so that the first perforation set is straddled between the packers creating an isolation zone and drawing fluid annulus fluid into the central conduit and discharging it into the annulus external to the isolation zone;

d) drawing fluid from the formation into the central conduit, storing the formation fluid in the first of the multiple sample containers and shutting off the sample container;

e) positioning the sampling tool near the next perforation set, setting the packers so that the perforation set is straddled between the packers, repeating steps c) and d), storing the formation fluid in successive sample containers until samples have been retrieved for each perforation set and retrieving the sample tool.

2. The method according to claim 1, wherein the sampling tool further comprises a fluid analyzer to determine characteristics of fluid in the central conduit to ensure that the fluid stored in the sample containers is formation fluid.

3. The method according to one claim 1, wherein the lowermost perforation set is marked, and the sampling tool comprises a device for detecting the marker.

4. The method according to claim 3, wherein the marker is a radioactive tracer, and wherein the sampling tool comprises a nuclear tool for detecting the radioactive tracer.

5. The method according to claim 4, wherein the nuclear tool is a gamma ray detector.

* * * * *